United States Patent [19]

Peltier et al.

[11] Patent Number: 4,852,665

[45] Date of Patent: Aug. 1, 1989

[54] METHOD FOR MONITORING THE OPERATIONS OF THE ROTARY DRILLING OF A WELL

[75] Inventors: Bertrand Peltier, Paris; Richard Deshais, Courbevoie, both of France

[73] Assignee: Schlumberger Technology Corporation, Houston, Tex.

[21] Appl. No.: 123,075

[22] Filed: Nov. 19, 1987

[30] Foreign Application Priority Data

Dec. 10, 1986 [FR] France ..... 86 17304

[51] Int. Cl.[4] ..... E21B 47/04

[52] U.S. Cl. ..... 175/40; 175/27; 73/151; 73/151.5; 364/422

[58] Field of Search ..... 175/24, 27, 38, 40; 166/250, 255; 73/151, 151.5; 364/422; 346/33 R, 33 WL

[56] References Cited

U.S. PATENT DOCUMENTS

| | | | |
|---|---|---|---|
| Re. 21,297 | 12/1939 | Mizell | 73/151.5 |
| 2,166,212 | 7/1939 | Hayward . | |
| 2,221,767 | 11/1940 | Hayward et al. | 175/40 |
| 2,287,819 | 6/1942 | Nichols | 175/40 |
| 3,076,966 | 2/1963 | Suter et al. | 73/151.5 |
| 3,514,852 | 11/1970 | Brown et al. | 73/151.5 |
| 3,605,919 | 9/1971 | Bromell et al. . | |
| 3,651,871 | 3/1972 | Greene | 175/40 X |
| 3,891,038 | 6/1975 | Delestrade et al. | 175/27 X |
| 4,139,891 | 2/1979 | Sheldon et al. . | |
| 4,610,005 | 9/1986 | Utasi | 73/151.5 X |
| 4,616,321 | 10/1986 | Chan . | |

FOREIGN PATENT DOCUMENTS

| | | |
|---|---|---|
| 2119833 | 11/1983 | United Kingdom . |
| 2156402 | 10/1985 | United Kingdom . |

*Primary Examiner*—Bruce M. Kisliuk

*Attorney, Agent, or Firm*—Stephen L. Borst

[57] ABSTRACT

The invention relates to the monitoring of the drilling operations of a well using a drill bit mounted at the end of a drill string, which can be taken up by the travelling block of a lifting gear installed in a derrick, in order to permit the addition or removal of members from the drill string. By measurement with the aid of sensors associated with the lifting gear and connected to a processing unit, the altitude and the hook load of the travelling block, it is possible to plot the curve, form which it is possible to deduce information concerning the structure and the behavior of the well being drilled.

8 Claims, 11 Drawing Sheets

METHOD FOR MONITORING THE OPERATIONS OF THE ROTARY DRILLING OF A WELL

Figure 1:
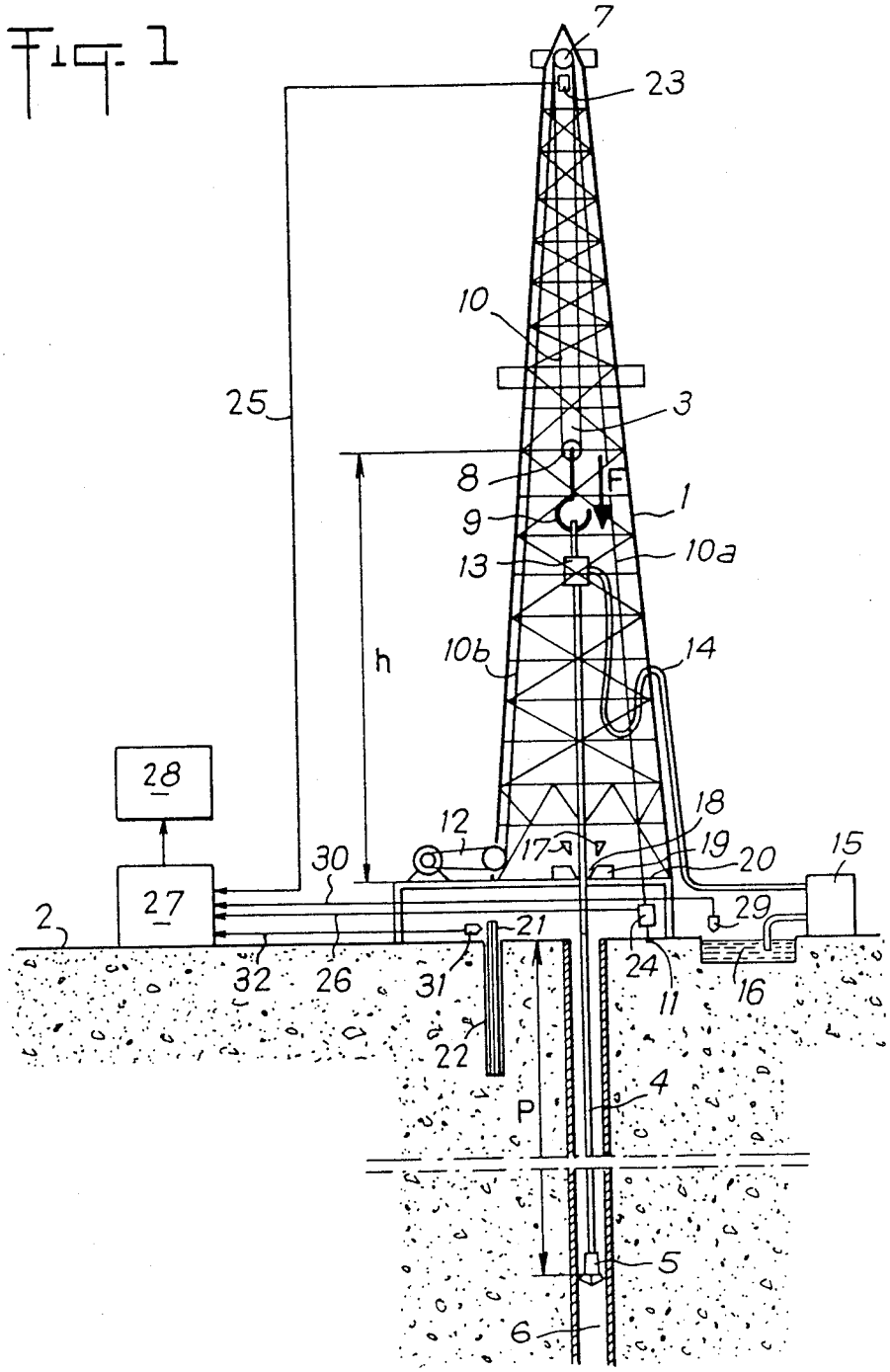

The invention relates to a method for monitoring the operations for drilling a well according to the rotary system using a drill string equipped with a drill bit and which can be taken up by a lifting gear having a mobile gripping element, such as a travelling block, on which is suspended the drill string formed by members joined end to end in variable numbers, members being successively added or removed as a function of whether it is a question of lowering or raising the drill bit with respect to the well, whilst for permitting the addition or removal of elements of the drill string, the latter is periodically placed on wedges so that it can be detached from the mobile gripping element.

When it is necessary to raise the drill bit during drilling, e.g. because it is worn and has to be changed, the drill string is extracted and dismantled member by member (each of these members generally being formed by three drill pipes). Then, when drilling has to be resumed, the drill string is re-formed by reassembling one by one each of its members and then by lowering it stepwise into the well.

In order to be performed in satisfactory manner, such operations require the maintenance of a strict compatibility between the members used and the length of the pipes respectively forming the same. For example, an error could lead to the reformation of a longer drill string, whose drill bit, during its relowering, would reach full speed at the bototm of the well and would brutally strike against the same, which would lead to considerable damage.

It is therefore necessary to permanently know the length of the drill string corresponding to the penetration depth of the drill in the well (it should be noted that the expression "penetration depth" used here and in the remainder of the text is not limitative with respect to the direction of the well and that it can apply to a vertical, an oblique or even a horizontal well).

However, the operations of measuring and assembling of the drill strings are performed entirely manually by human operators. Bearing in mind the often difficult working conditions at the drilling locations, errors are inevitable. Moreover, all measurements performed during a drilling operation are characterized by the instant at which they were performed (the time at which a particular measurement was made being noted) and it is not easy to determine the depth at which the drill bit was at this particular time. However, it is to this depth that each of the measurements performed should be related and particularly the measurements of the force of friction between the subterranean formation and the drill string, so as to be able to associate areas with problems which may be encountered in the well.

In order to obviate the disadvantages of the existing manual procedures, the invention aims at permitting a precise and automatic determination of geometrical and mechanical parameters appropriate for characterizing the structure and the movement of the drill string in the well. The invention aims at also permitting a precise determination of the different parameters measured during the drilling or handling operations of the drill string, as a function of the drill bit penetration depth.

To this end, according to the present invention, a permanent measurement takes place, as a function of time, of the variable height of the travelling block and of the hook load applied thereto and, following appropriate processing, from these two measurements is deduced the value of said hook load as a function of the penetration depth of the drill bit. It is consequently possible to evaluate the friction force to which the drill string is exposed in the well in a direct manner, as a function of the position of the drill bit therein.

Advantageously, the penetration depth of the drill bit is obtained by automatic algebraic summation of the successive loaded strokes or travels performed by the travelling block.

It is also appropriate to eliminate the values of the travelling block altitude and load during the time intervals which are also eliminated where said load is below a predetermined threshold value, said travelling block then being considered as "empty". However, as soon as its load exceeds said threshold value, the travelling block is considered to be "loaded". On also eliminating the travelling block altitude and load values during the periods, which are also eliminated from the time record, before and immediately after said time intervals where the altitude of the travelling block varies in a non-monotonic manner with respect to its variation during its loaded strokes, and load altitude values are obtained which are univocally related with the time.

It will be understood that by "monotonic" is meant the usual mathematic definition of having the property of never decreasing (or never increasing) as the independent variable increases. This definition implies that the slope of a monotonic curve is always zero or positive (or always zero or negative) so that non-monotonic portions of the curve may be identified by comparing different values along the curve or by calculating the slope or the derivative along the curve.

More particularly, during a drill bit "tripping out" operation, these eliminations can be performed by eliminating the altitude and load values as from a first instant where, during the placing of the drill string on wedges, the altitude of the travelling block stops increasing and in fact decreases somewhat and up to a second instant where said altitude, during the release of the drill string from the wedges, reassumes the value which it had at the first instant, after deducting the empty travel of the travelling block whilst the drill string was on wedges. In a somewhat different manner, during a drill bit lowering operation, these eliminations can be performed by eliminating the travelling block altitude and load values as from a first instant where, on being lowered, it reaches an altitude slightly above that corresponding to the passage of the load through the threshold value and up to a second instant where, on re-descending, it assumes the same altitude, after deduction of the empty travel performed by the travelling block whilst the drill string was on wedges.

Thus, from the measurement of the amplitude of the successive strokes or travels performed by the travelling block between the instants where its load passes through the threshold value, it is possible to deduce the length of the members of the drill string successively added or removed. This same measurement also makes it possible, during the actual drilling operations, to determine the length of the different pipes used for forming the drill string, the successively added members being reduced in this case to single pipes and to draw up a specification of the drill pipes of the drill string using the thus obtained results.

Other useful information concerning the performance of the operations can be obtained through the measurements performed in the method according to the invention. When, as is conventionally the case, the measurement of the values of at least one parameter relative to the well takes place as a function of time, the values of this parameter are measured synchronously with the load applied to the travelling block and, as a result of the inventive method, it is possible to convert said values as a function of the drill bit penetration depth with the aid of the load values determined as a function of said depth. In parallel and by derivation with respect to the time of the drill bit depth it is possible to determine the displacement speed thereof in the well as a function of its depth. This makes it possible to ensure that the drill string does not reach translation speeds which might cause swabbing phenomena in the well. Moreover, when as is usually the case, drilling mud is injected into the well from a mud pit, which receives the excess mud from the well, the measurement of the mud volume leaving the mud pit or which is returned to it and the comparison of the results of this measurement with theoretical values corresponding to the variations of the volume occupied by the drill string in the well makes it possible to make a mud balance indicating whether, in the well, there is a loss or gain of fluid and to what extent this is the case and from this information it is possible to obtain details on the nature and structure of the formation.

For each loaded stroke of the travelling block, it is also of interest to measure the duration of possible interruptions to the normal displacement of the drill string attached thereto leading to a stoppage or a short backstroke. Thus, information is obtained on the time used for manipulating each member of the drill string and on the possible appearance of incidents during operations.

Other features and advantages of the invention can be more clearly gathered from the following description of a non-limitative embodiment of the present method, with reference to the drawings.

FIG. 1 Diagrammatically and in vertical section, a rotary derrick and the well which it surmounts.

Figure 2:
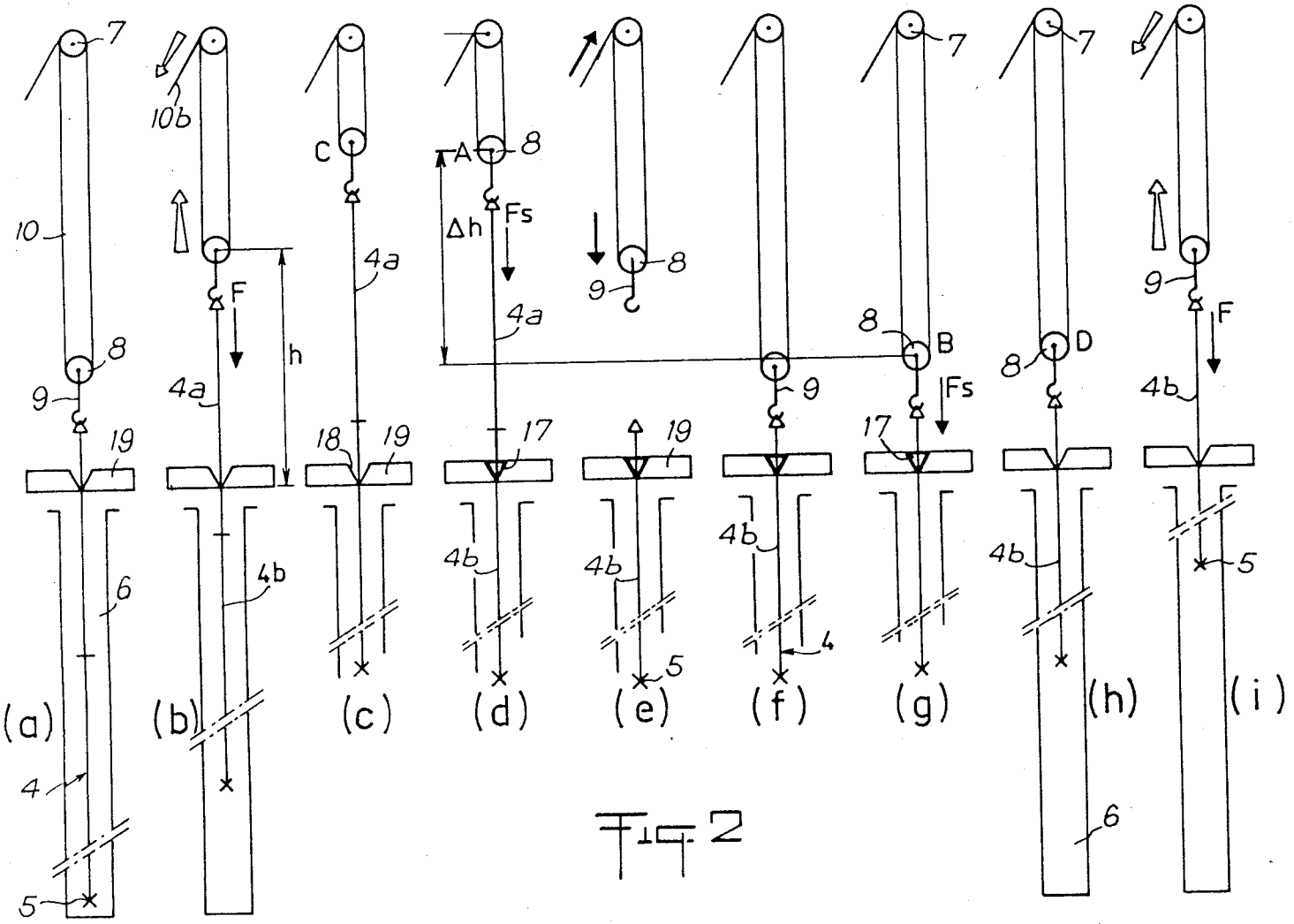

FIG. 2 Diagrammatically, the different phases of the operation of withdrawing a drill string member during the raising of the drill bit.

Figure 3:
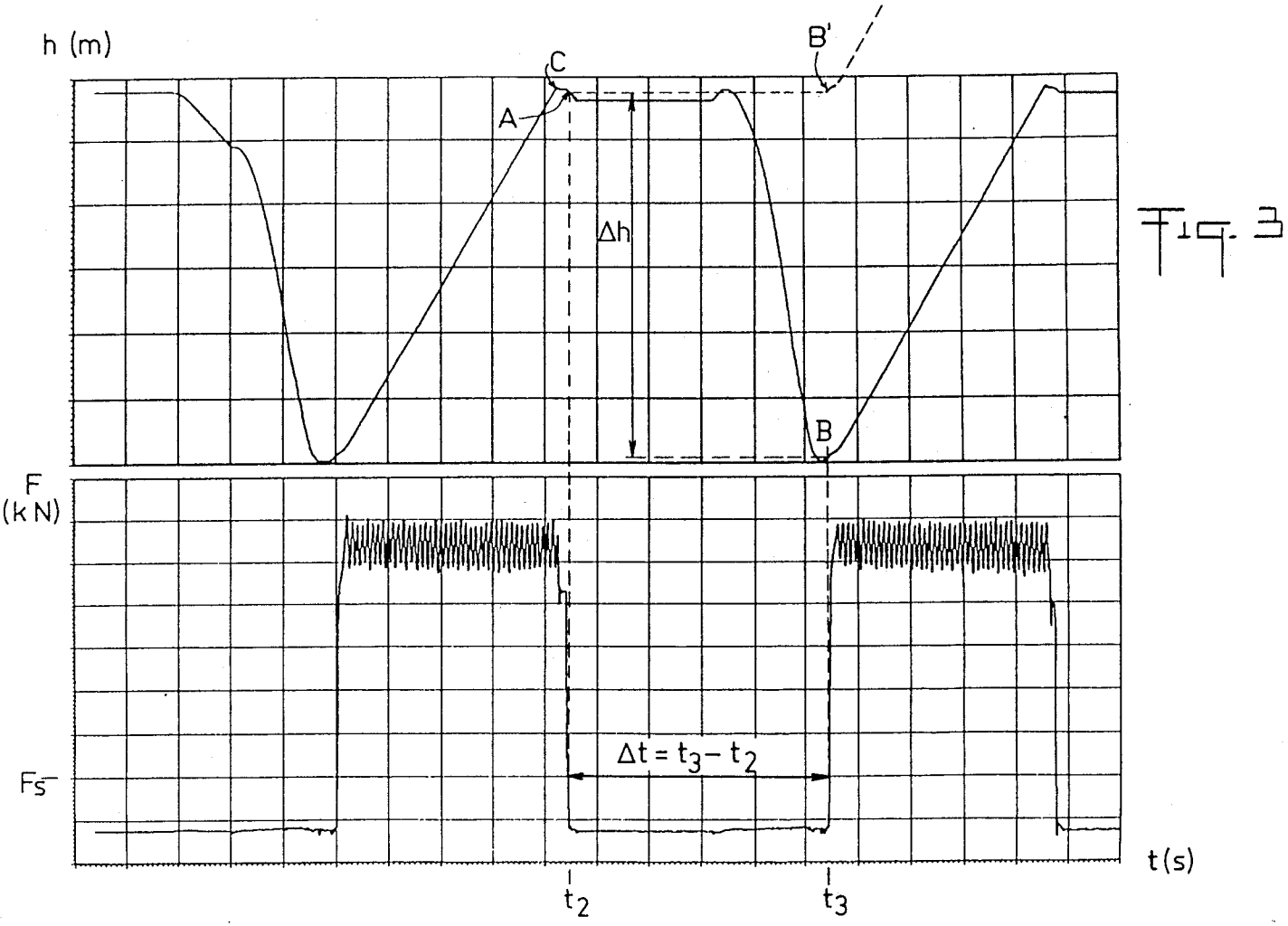

FIG. 3 Part of a tape for recording the values measured, as a function of time, of the altitude and hook load of the travelling block belonging to the lifting gear equipping the derrick.

Figure 4:
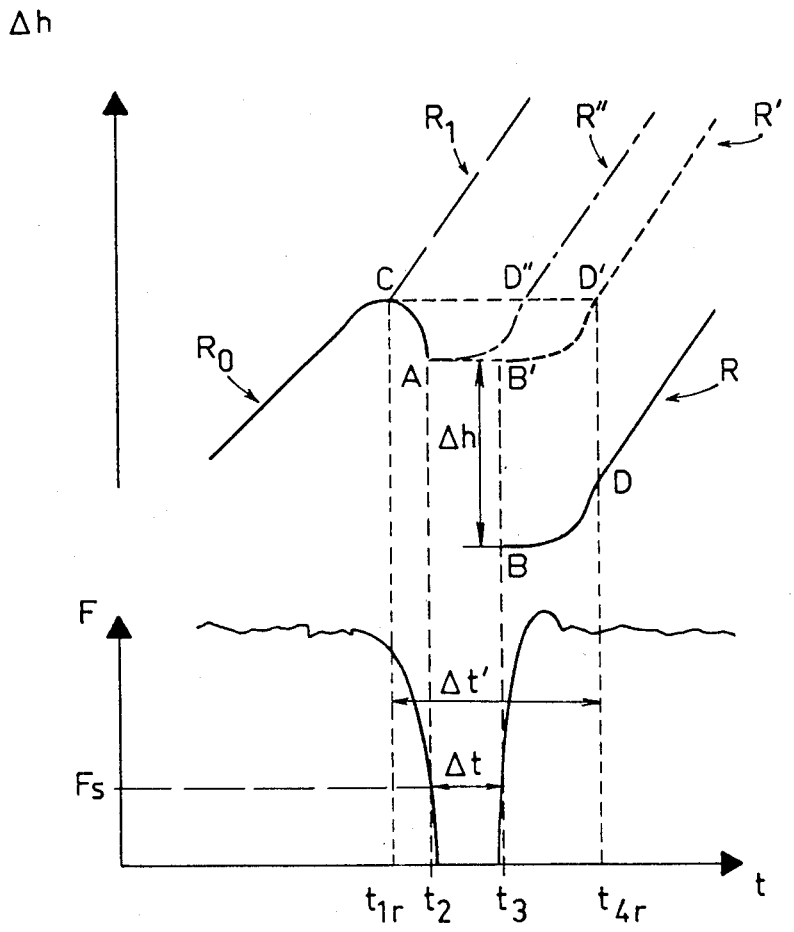

FIG. 4 Diagrammatically, a portion corresponding to a withdrawal period of a member of the drill string of the curves of FIG. 3 and illustrating the processing used to obtain the curve of the cumulative amplitudes of the strokes of the travelling block.

Figure 5:
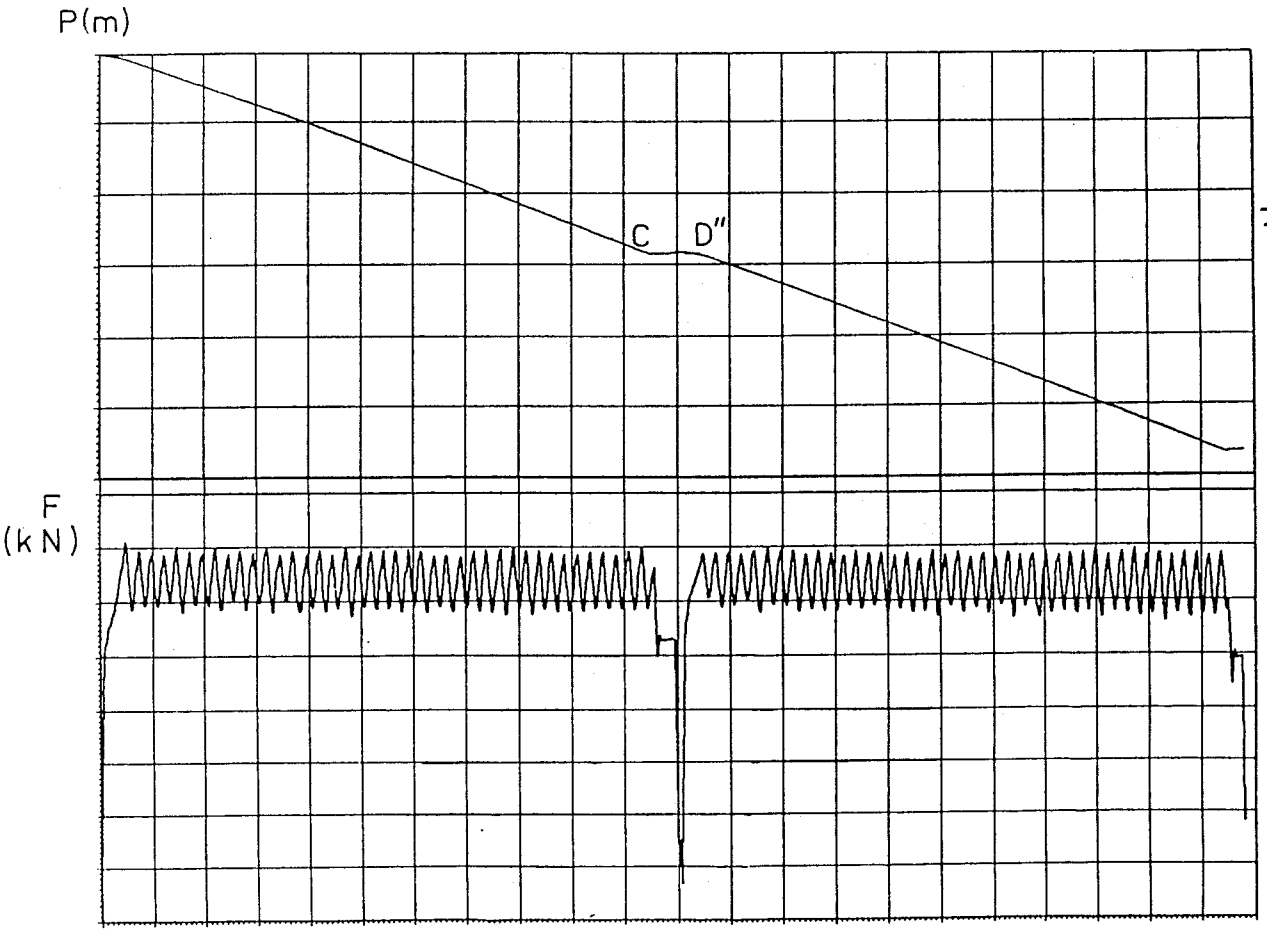
Figure 6:
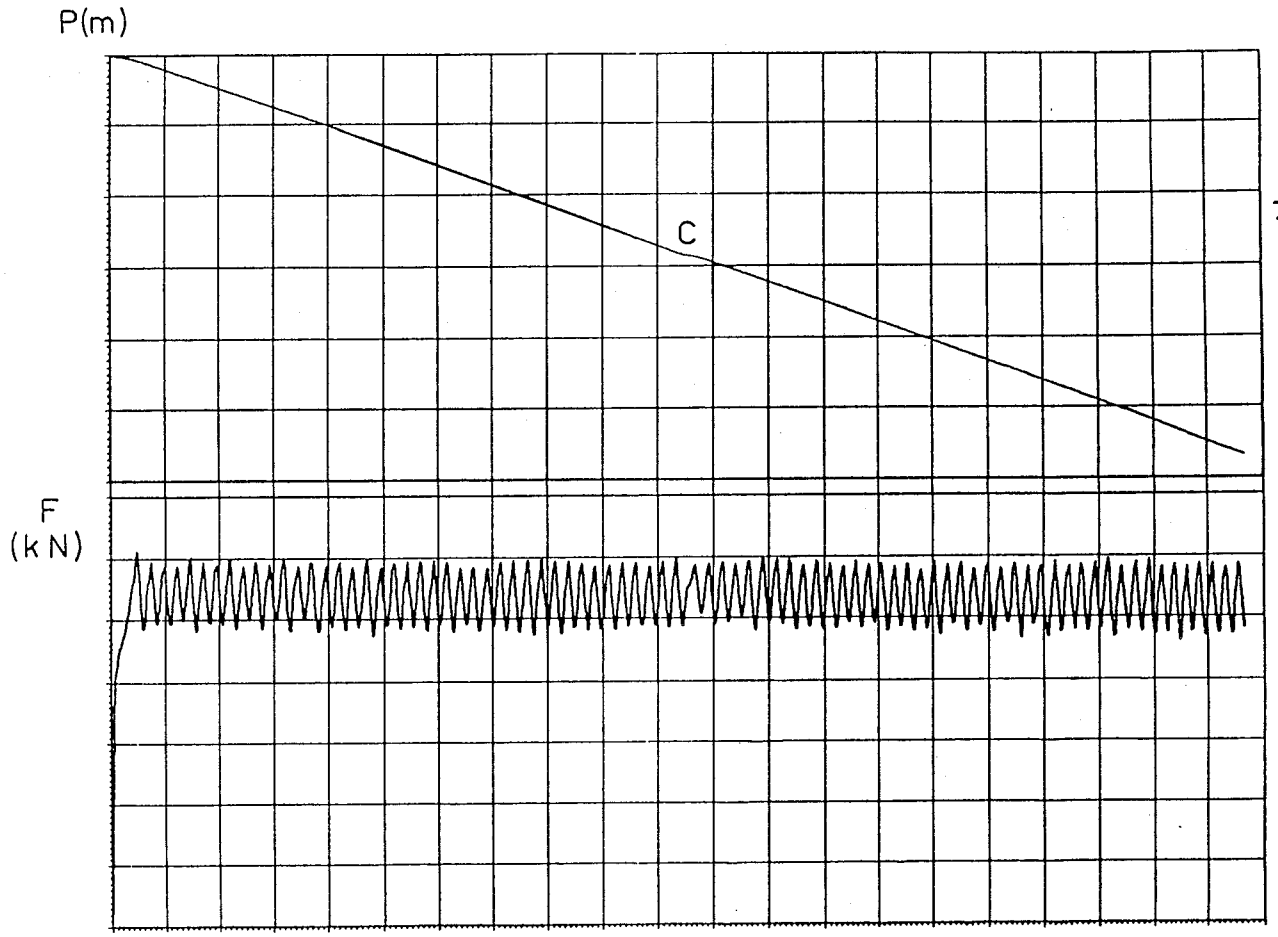

FIGS. 5 and 6 Portions of the recording tape corresponding to that of FIG. 3, but respectively after partial and complete performance of the processing illustrated in FIG. 4, so that the upper curve gives the penetration depth of the drill bit.

Figure 7:
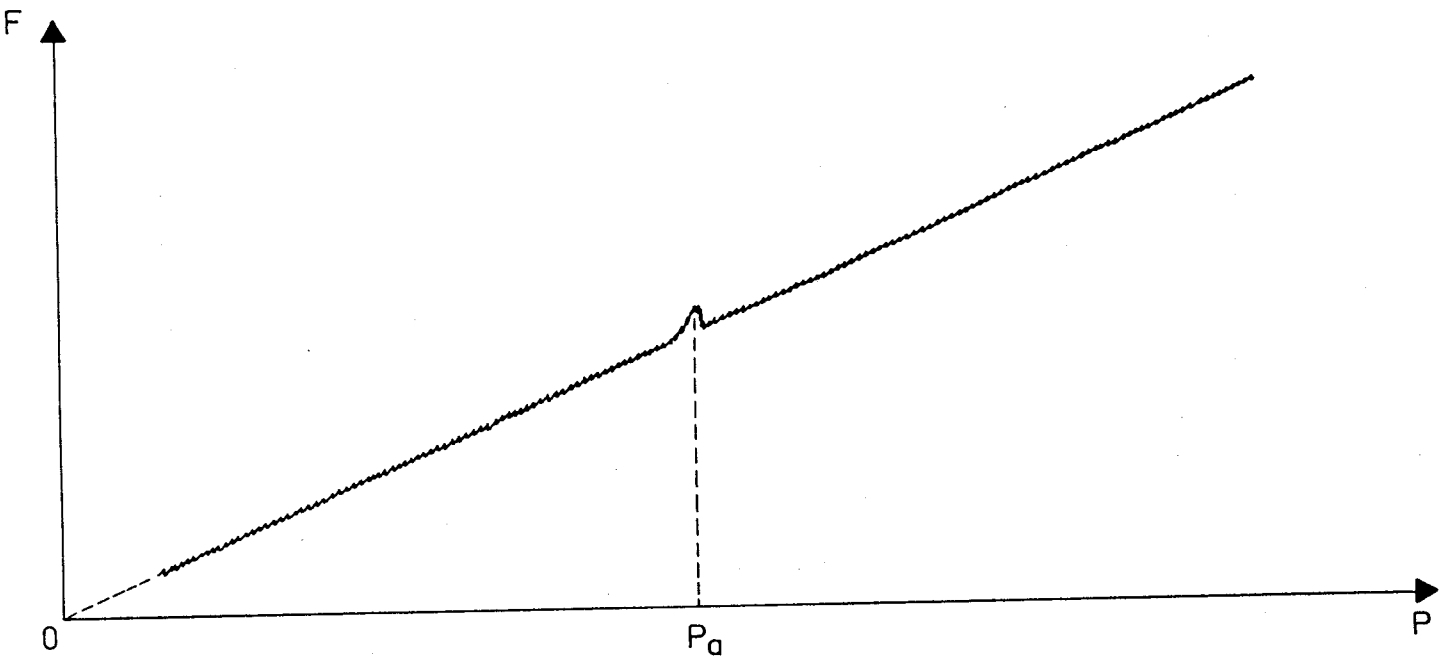

FIG. 7 The curve, based on the preceding curves, of the hook load of the travelling block as a function of the drill bit depth.

Figure 8:
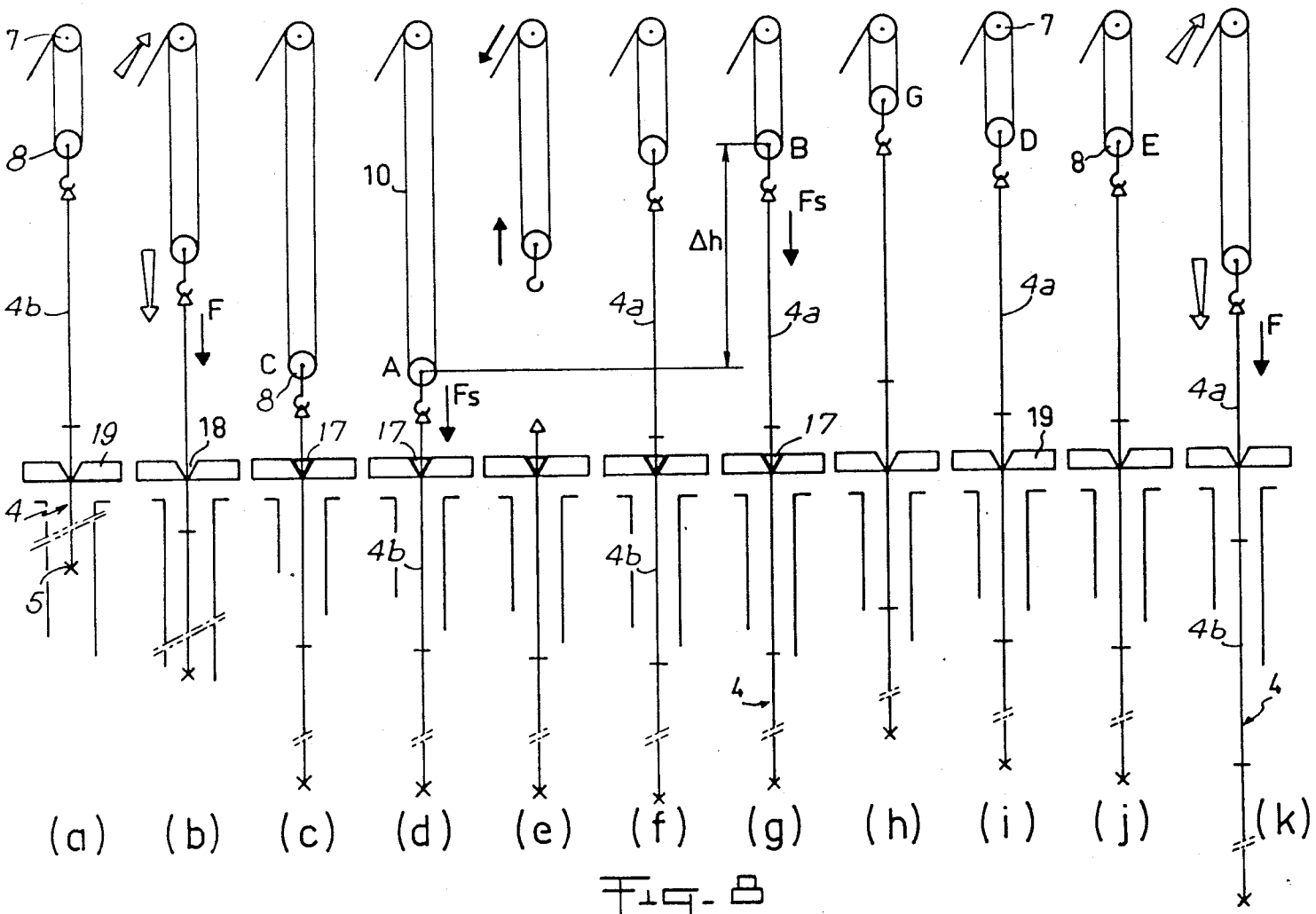
Figure 9:
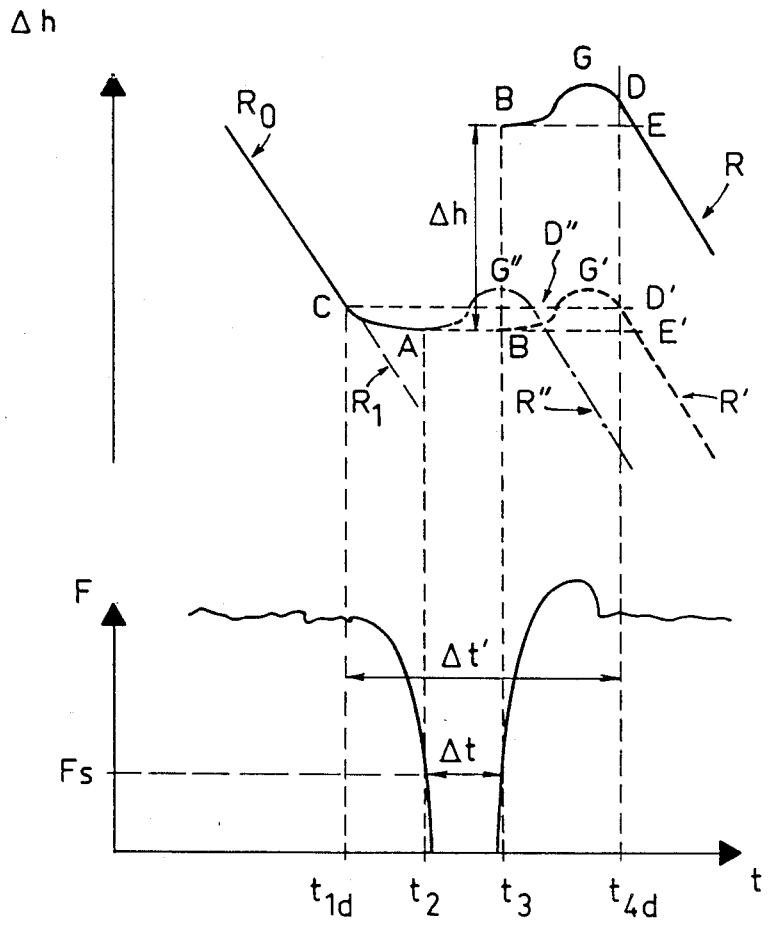

FIGS. 8 and 9 In the manner of FIGS. 2 and 3, respectively the successive phases of the operation for adding a drill string member during the lowering of the drill bit and the curves corresponding to this operation.

Figure 10:
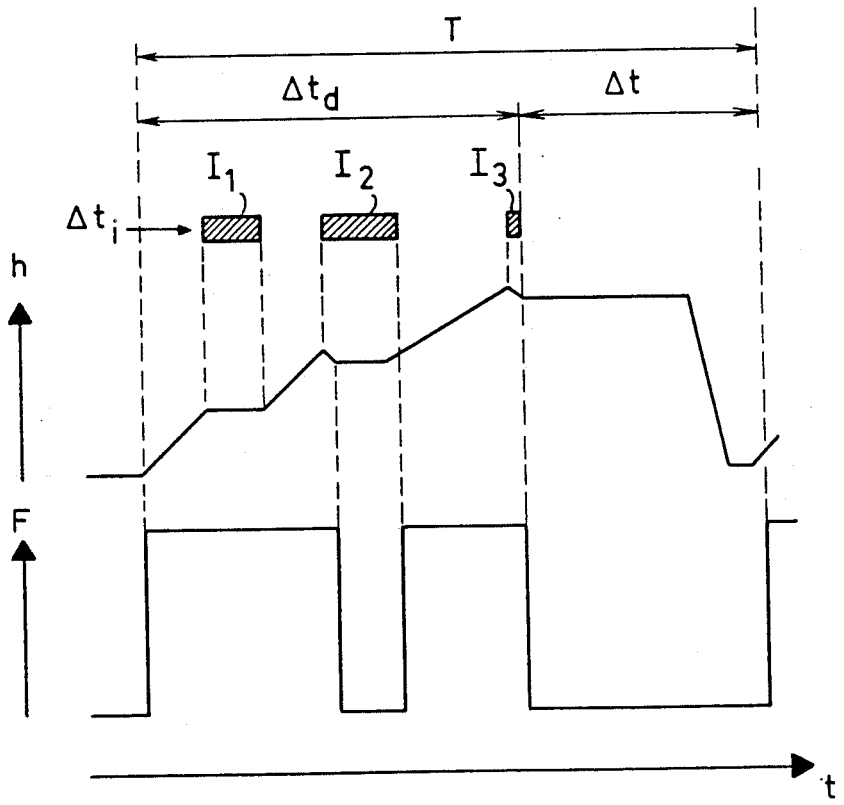

FIG. 10 Diagrammatically a portion of the curves recorded revealing manipulating incidents.

Figure 11:
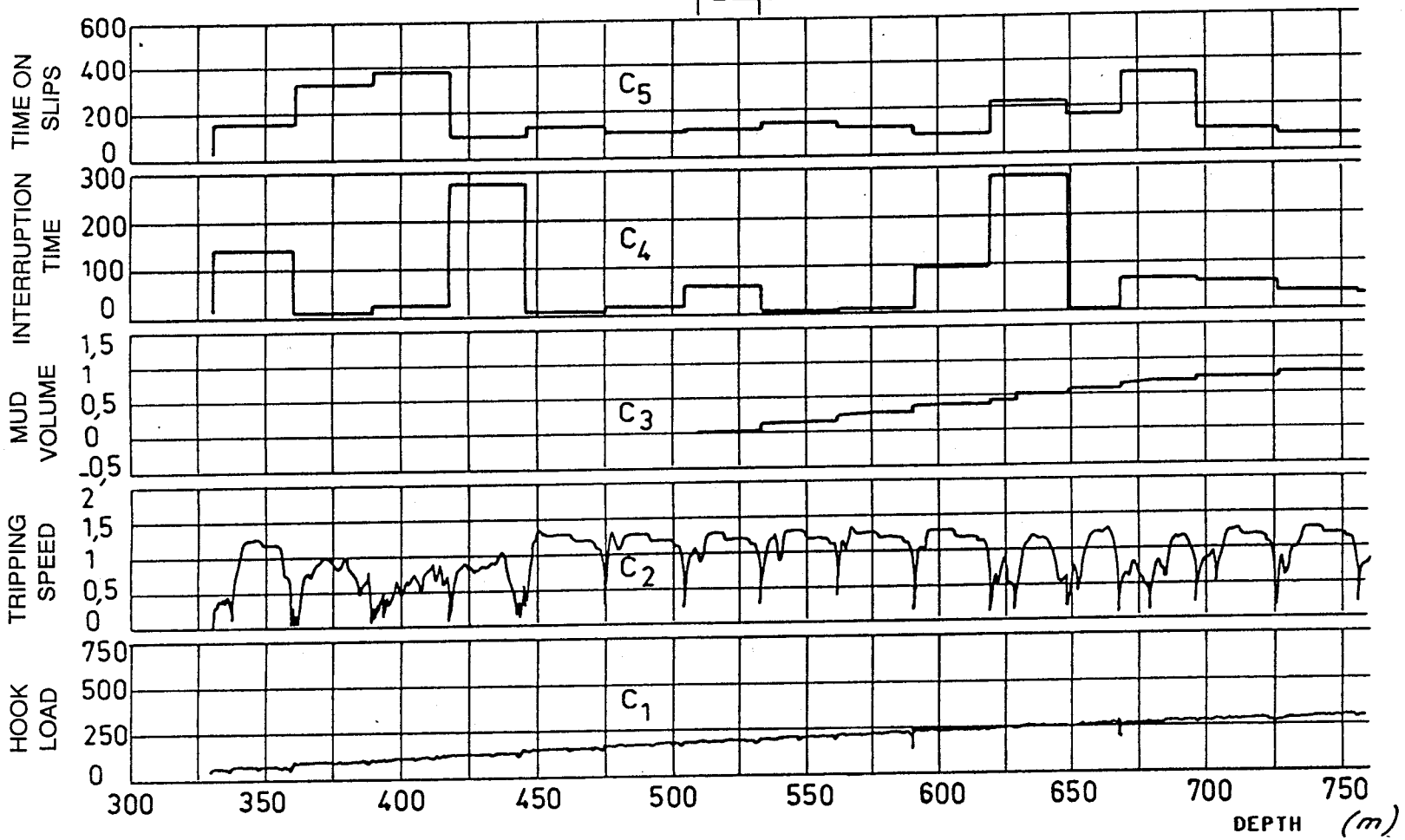

FIG. 11 In part, a tape recording various parameters during the raising of the drill string.

The rotary derrick shown in FIG. 1 comprises a mast 1 standing on the ground 2 and equipped with a lifting gear 3, on which is suspended a drill string 4 formed from pipes joined end to end by screwing and carrying at its lower end a drill bit 5 for drilling a well 6. Lifting gear 3 comprises a crown block 7, whose spindle is fixed to the top of the mast 1, a vertically mobile travelling block 8, to which is attached a hook 9, a cable 10 passing over blocks 7 and 8 and forming, as from the crown block 7, on one side an inactive portion 10a anchored to a fixed point 11 and on the other side an active portion 10b wound on to the drum of a winch 12.

As stated, outside drilling periods, the drill string 4 can be suspended on hook 9 via an injection head 13 connected by a flexible hose 14 to a mud pump 15, which makes it possible to inject into the well 6, via hollow pipes of string 4, drilling mud from a mud pit 16, which can also receive excess mud from the well 6. By operating the lifting gear 3 by means of winch 12, this makes it possible to raise the drill string 4, its pipes being successively withdrawn from well 6 and unscrewed so as to extract the drill bit 5, or to lower the drill string 4, following the successive rescrewing of the pipes forming it, in order to return the drill bit to the bottom of the well. These pipe assembly and disassembly operations with regards to the pipes makes it possible to momentarily unhook the drill string 4 from the lifting gear 3. Drill string 4 is then supported by wedging using wedges or slips 17 in a conical recess 18 of a rotary table 19 mounted on a platform 20 and which is traversed by the drill string.

During drilling periods, the drill string 4 is rotated via a square pipe or "kelly" 21 mounted at its upper end. Between said periods, said square pipe is again placed in a sleeve or "rat hole" 22 made in the ground.

The operations of raising a drill string 4 will now be described relative to FIG. 2, which diagrammatically show, in different successive phases, blocks 7, 8 and cable 10 of the lifting gear, hook 9 and table 19 traversed by the drill string.

With the travelling block 8 initially in the bottom position according to FIG. 2(*a*), it is moved upwards by means of winch 12 pulling the active portion 10*b*. Its altitude h above platform 20 (chosen as the reference plane) increases and the drill string 4, suspended thereon, rises according to FIG. 2(*b*). When the upper member 4*a* of the drill string, which is to be disassembled and removed (it generally comprises three pipes) is entirely below table 19, according to FIG. 2(*c*), the upward movement of block 8 is stopped and wedges 17 are placed in the conical recess 18 of table 19 and cable 10 is slackened slightly, so that the slightly descending drill string 4 is taken up by wedging according to FIG. 2(*d*). Member 4*a* is disassembled, removed and the block 8 is lowered again empty according to FIG. 2(*e*) and hook 9 thereof grasps the following member 4*b* of the drill string according to FIG. 2(*f*). The latter is released, whilst slightly raising block 8 according to FIG. 2(*g*) and the wedges 17 are removed according to FIG. 2(*h*). The drill string, again taken up by block 8, but from which member 4*a* has been removed, then performs a further rising stage during the upward movement of the block according to FIG. 2(*i*).

The variations of the altitude h of the travelling block 8 during these operations of raising the drill string 4 are measured by means of a sensor or transducer 23. In the present case it is a rotation angle sensor coupled to the fastest pulley of the crown block 7 (i.e. the pulley from which the active portion 10b departs). At each instant, this sensor gives the magnitude and rotation direction of said pulley from which it is easy to deduce the value and the direction of the linear displacement of cable 10 and then, bearing in mind the number of cable portions connecting blocks 7 and 8, the displacement value and direction of travelling block 8 and consequently its altitude h. As a variant, said altitude h could be directly measured with the aid of a laser optical sensor operating on the radar principle.

Apart from its altitude h, the load F applied to the hook 9 of the travelling block 8 is measured and substantially corresponds to the weight of drill string 4, which varies with the number of pipes in the latter. This measurement is performed with the aid of a force transducer or sensor 24 inserted in the inactive portion 10a of cable 10 and which measures the tension of the latter. By multiplying the value supplied by said sensor by the number of portions connecting blocks 7 and 8, the load on hook load F of block 8 is obtained. Sensors 23 and 24 are connected by lines 25 and 26 to a calculating unit 27, which processes the measuring signals and applies them to a recorder 28.

FIG. 3 gives an example of the curves obtained by recording on paper values measured, as a function of time, of altitude h and hook load F of travelling block 8. These curves respectively have a truncated sawtooth shape and a rectangular shape. The rectilinear slopes of the curve representing the hook load F with the top portions of the curve representing the hook load F and correspond to the upward travel of block 8 when it brings about the raising of drill string 4, cf. FIGS. 2 (a), (b) and (c).

The demarcation of the time intervals, where hook 9 of block 8 is loaded, the drill string being attached thereto, and the time interval $\Delta t$ when hook 9 is empty, freed from the drill string, is defined by the passage of load F through a predetermined threshold value $F_s$, determined experimentally in such a way that the value of load F increases monotonically in the time period corresponding to the load rise. This passage occurs at an instant $t_2$ during the placing of the drill string on wedges 17, cf. FIG. 2 (*d*) and at an instant $t_3$ during its extraction from the wedges, cf. FIG. 2 (*g*). On the curve of altitude h, to these instants respectively correspond points A and B, whereof the ordinate difference represents the downward travel $\Delta h$ to be performed by block 8 between the detachment of member 4*a* from the drill string, cf. FIG. 2 (*d*) and the attachment of the following "member 4*b*, cf. FIG. 2 (*g*). The hook load at these precise instants is equal to the threshold value $F_s$ in such a way that the tension of cable 10 is always the same. This eliminates the influence of the extensibility of the cable on the measurement of altitude h. Thus, this quantity $\Delta h$ is the measure of the length of member 4a subtracted from the drill string.

By adding all the values $\Delta h$ measured during the reassembly of the drill string, it is possible, assuming that the initial length of the drill string prior to its reassembly is known, to determine at each instant the effective length of the drill string, whose rods are reassembled and disassembled member by member. This addition is graphically illustrated in FIG. 3 in which that portion of the curve to the right of point B has been raised through a distance $\Delta h$ to become the dotted curve which passes through point B'. In FIG. 4 this adjustment is shown to have moved the curve R through a vertical upward distance $\Delta h$ with respect to the preceding curve $R_o$. This gives a curve R' in FIG. 4 whose initial point B' is vertically above point B and which corresponds to instant $t_3$ (along the abscissa) with the same ordinate as point A. This procedure is followed for each stroke of the travelling bock 8, so that a cumulative curve comprising an accumulation of lengths $\Delta h$ as a function of time is obtained.

The curve so formed includes a succession of slopes linked by a plurality of portions AB' which correspond to a succession of time intervals $\Delta t = t_3 - t_2$. By appropriate processing, the portions of the abscissa corresponding to time intervals $\Delta t = t_3 - t_2$ are deleted along with the corresponding portions AB'. The effect is to shift curve R' to the left to become curve R as illustrated in FIG. 4. As shown by FIG. 5 adjacent portions of the curve with similar slopes are then virtually an extension of one another. However, this curve is not monotonic in the connection zones C–D''. There is also a corresponding anomaly on the curve of the hook load F.

A monotonic curve may be obtained by next eliminating the time interval between points C and D''. Point C corresponds to the apex of the relative maximum of the curve $R_o$ and point D'' corresponds to the point having the same ordinate at the start of curve R''. This procedure has the affect of moving point D of curve R to point C of curve $R_o$ via points D' and D'' which respectively correspond to the situations illustrated by FIGS. 2 (c) and (h). The resulting perfectly monotonic depth curve P is shown in FIG. 6. Moreover, in view of the fact that this process suppresses a time interval $\Delta t'$, corresponding to segment CD', it leads to the deletion of the aforementioned anomaly of the curve of the hook load F of FIG. 5 to produce the curve, shown in FIG. 6.

The two curves P and F in FIG. 6 are plotted as a function of time. However, this is a "truncated" time, from which the aforementioned intervals $\Delta t'$ have been removed, so that as a first approximation, account is only taken of the time during which the hook of the travelling block is loaded. However, this truncated time scale is common to the two curves, so that it is easy to deduce therefrom the curve of the hook load F as a function of the drill bit depth P (FIG. 7). As the drill string 4 has a homogeneous uniform structure, said curve is in principle a straight line passing through the origin 0 and having as its gradient the weight per unit length of the pipes in the mud.

In fact, the hook load F not only results from the weight of the drill string, but also from the friction thereof in the well during the longitudinal displacement thereof. When a portion of the well has an anomaly modifying the friction conditions of the well wall (caving in, creep zone, heave of the area traversed, etc.), the passage of the drill bit at this level is marked by a sudden increase in the value of F, as can be seen in the graph of FIG. 7 at depth $P_a$. Thus, the anomaly is detected and its depth indicated, so that measures can subsequently be taken to obviate it (cleaning, mud treatment, etc.). Thus, the evolution of the anomaly can be followed during the successive operations of lowering or raising the drill string.

The different phases of adding a new member 4a to the drill string 4 during lowering are illustrated in FIG. 8.

(a) : Travelling block 8 with the drill string 4 attached to it by its upper member 4b is in the top position.
(b) : Block 8 descends accompanied by the drill string.
(c) : With block 8 in the vicinity of its bottom position, the keying wedges 17 of the drill string are put into place.
(d) : The drill string is taken up by the wedges 17, accompanied by a slight lowering of the latter and of block 8.
(e) : Block 8, detached from the drill string, rises empty into the top position.
(f) : A new member 4a is added to the drill string.
(g) : Slight raising of the drill string with the aid of block 8 to permit the removal of the keying wedges 17.
(h) : Removal of the keying wedges 17.
(i), (j) and (k) : lowering of the drill string to which member 4a has been added.

The positions of the travelling block in FIGS. 8 (*d*) and (*g*) are assumed to correspond to the passage of the hook load F through the threshold value Fs, the altitude difference Δh of the block between its positions being taken as the measure of the length of the added member 4a.

As in the case of the raising of the drill string, the corresponding curve of the altitude h of the travelling block while lowering the drill string also has a sawtooth shape as a function of time. The rectilinear slopes of this corresponding curve are negative. The interconnection of these curves are graphically illustrated in FIG. 9. Following a procedure similar to that described above for the case of raising the drill string, point D of curve R may be translated through various processing steps to point C of curve $R_o$. This gives curve $R_1$ which is perfectly connected to the preceding curve $R_o$: the overall curve having a monotonic downward variation in the region of the connection. The above processing leads to the elimination of the time interval Δt' corresponding to segment CD', which eliminates any negative peak in the curve of the hook load F.

From the curve of the cumulative Δh, graduated in drill bit depth, and the curve of the hook load F, said two curves being processed in the manner indicated hereinbefore, is deduced the curve F (P of the hook load as a function of the drill bit depth). In principle, it is a straight line like that of FIG. 7.

Useful information can be obtained from the curves representing the altitude h and the load F of the travelling block, like those of FIG. 3, in connection with the raising of the drill string. As can be seen from identical curves diagrammatically shown in FIG. 10, they make it possible to plot for each outward and return travel of the travelling block the duration T of said outward and return travel, the time Δt during which the drill string is kept stationary in wedges 17, the complementary time $\Delta t_d$ during which the drill string is moved and the cumulative time $\Delta t_i$ corresponding to various manipulation incidents $I_1$, $I_2$, $I_3$ (e.g. during incident $I_1$ the block had to be momentarily stopped, during incident $I_2$ it was also necessary to replace the drill string on the wedges).

Time Δt, during which a member of the drill string has been unscrewed, unhooked from the travelling block and re-fitted, followed by the reattachment of the travelling block to the drill string, makes it possible to evaluate the speed of the team responsible for manipulating the drill string. Time $\Delta t_i$, which represents the total duration of possible incidents, makes it possible to detect them and, by examining the curves, to characterize them and remedy them for following operations.

FIG. 1 shows the presence of a sensor 29 measuring the level of the mud in pit 16 and connected by a line 30 to the calculating unit 27. The latter compares the mud volume entering or leaving well 6 with the volume of the immersed part of the drill string 4, which is dependent on the depth of the drill bit. By interpreting the differences detected between these volumes, which should normally exactly correspond, it is possible to know whether there is a liquid gain or loss and consequently information can be obtained on well phenomena as a result of the interaction between the moving drill string and the formation.

There is also a sensor 31 connected to the calculating unit 27 by a line 32 , whose function is to detect the presence or absence of the square pipe 21 in its sleeve 22 and thus establish whether there is a drill string manipulating period or a drilling period. These informations are obtained not only as a function of time, but also as a function of the drill bit penetration depth.

FIG. 11 is an example of curves plotted simultaneously by recorder 28, linked with the calculating unit 27, during the operations of raising a drill string. All these curves are related to the depth P of the drill bit on the abscissa. Curve $C_1$ gives the evolution of the hook load of the travelling block 8 of lifting gear 3. Curve $C_2$ gives the variations of the manipulating speed of the travelling block. Curve $C_3$ shows the variation of the mud volume in the pit 16. Curve $C_4$ gives information on the total interruption time $\Delta t_i$ of the displacement of the travelling block for each upstroke thereof. Curve $C_5$ indicates the time Δt during which the drill string remains on wedges during each withdrawal of a group of pipes (generally consisting of three 9 metre pipes).

We claim:

1. A method for determining the depth at which a parameter measured during a drilling operation is acquired, said depth being the depth in a borehole of the end of a string suspended from a vertically moveable block, said string consisting of a plurality of incremental members which may be added to or removed from said string, said method comprising the steps of:

a. deriving an indication of the weight of said string born by said block as a function of time;
b. deriving an indication of the vertical position of said block as a function of time;
c. deriving an indication of said parameter as a function of time;
d. in response to said weight indication, identifying those portions of said position indication which correspond to those times during which the weight of said string is not born by said block;
e. identifying those portions of said position indication which do not vary monotonically relative to the remaining portions of said position indication;
f. in response to the identifications of steps d. and e. and to said indication of said parameter , determining the depth at which said parameter was acquired and generating a log of said parameter as a function of depth.

2. A method according to claim 1, wherein said depth is obtained by the summation of the successive portions of said position indication which correspond to those times when said block bears the weight of said string.

3. A method according to claim 2, wherein said step of identifying those portions of said position indication which correspond to those times during which the weight of said string is not born by said block includes the step of comparing the values of said weight indication to a predetermined threshold.

4. A method according to claim 1, wherein during a string moving operation those portions of said position indication identified in steps d. and e. are suppressed as are the portions of said weight indication and said parameter indication which correspond in time to the suppressed portions of said position indication.

5. A method according to claim 1 further including the step of determining, in response to said position indication, the duration of interruptions of the normal displacement of said string by identifying those times during which said string is stopped or experiences a slight backstroke.

6. A method according to claim 1 wherein said parameter is the weight of said string.

7. A method according to claim 1 further including the steps of:

i. identifying those points in time that said weight indication passes through a predetermined threshhold;

ii. identifying the moments on said indication of vertical position which correspond to said points in time; and iii. determining the lengths of each of the individual members of said string as they are added to or removed from said string in response to steps i and ii.

8. A method according to claim 7 further including the step of producing an inventory record of the lengths of the members making up said string.

* * * * *